US006052887A

United States Patent [19]

Dziadosz et al.

[11] Patent Number: 6,052,887

[45] Date of Patent: Apr. 25, 2000

[54] APPARATUS AND METHOD FOR JOINING SHEET METAL LAYERS

[75] Inventors: Lawrence M. Dziadosz, Milford; Brian D. Hudock, Lake Orion, both of Mich.

[73] Assignee: Tower Automotive, Grand Rapids, Mich.

[21] Appl. No.: 08/929,811

[22] Filed: Sep. 15, 1997

Related U.S. Application Data

[60] Provisional application No. 60/025,239, Sep. 16, 1996.

[51] Int. Cl.[7] ..... B23P 11/00

[52] U.S. Cl. ..... 29/509; 29/243.5; 29/505; 72/313; 72/57

[58] Field of Search ..... 29/33 K, 243.57, 29/243.58, 505, 566.1, 509; 72/313, 314, 315, 316, 381, 460, 461

[56] References Cited

U.S. PATENT DOCUMENTS

| | | | |
|---|---|---|---|
| 2,391,997 | 1/1946 | Noble | 189/36 |
| 2,878,769 | 3/1959 | Lyon | 113/48 |
| 3,276,112 | 10/1966 | Tantlinger et al. | 29/432 |
| 3,699,626 | 10/1972 | Poth | 29/243.5 |
| 3,705,512 | 12/1972 | Koschatzky . | |
| 4,485,660 | 12/1984 | Takeuchi et al. | 72/313 |
| 4,535,619 | 8/1985 | Gargave | 72/481 |
| 4,540,391 | 9/1985 | Fries, Jr. | 493/287 |
| 4,757,609 | 7/1988 | Sawdon | 29/798 |
| 5,224,253 | 7/1993 | Sawa | 29/243.58 |
| 5,309,622 | 5/1994 | Pirchl | 29/566.1 |
| 5,361,620 | 11/1994 | Meadows | 72/387 |

FOREIGN PATENT DOCUMENTS

| | | | |
|---|---|---|---|
| 62-263824 | 11/1987 | Japan | 72/313 |
| WO 94/21740 | 9/1994 | WIPO . | |

*Primary Examiner*—S. Thomas Hughes
*Assistant Examiner*—Steve Blount
*Attorney, Agent, or Firm*—Oppenheimer Wolff & Donnelly LLP; Craig J. Lervick; Daniel G. Chapik

[57] ABSTRACT

A method for joining together two superimposed sheet metal layers includes clamping the sheet metal layers together on a base and positioning a resiliently deformable hemming bead adjacent the superimposed layers. One of the layers includes an outer peripheral flange that extends beyond the outer peripheral edge of the other layer. An anvil has a lower face that follows the bead around the periphery of the superimposed layers and presses against the bead to deform the bead toward the flange. Deformation of the hemming bead causes the peripheral flange of the one layer to bend around the peripheral edge of the other layer in a single operation to thereby join the superimposed sheet metal layers together.

18 Claims, 5 Drawing Sheets

APPARATUS AND METHOD FOR JOINING SHEET METAL LAYERS

RELATED APPLICATION

This application claims the benefit of U.S. Provisional Application No. 60/025,239 filed on Sep. 16, 1996.

BACKGROUND OF THE INVENTION

1. Field of the Invention

This invention relates to an apparatus and method for joining together sheet materials, and more particularly to a hemming apparatus and method for joining together two superimposed sheet metal layers.

2. Description of the Related Art

Heat shields and other articles having two superimposed sheet metal layers are typically joined together in a conventional hemming operation, wherein the outer periphery of one of the layers is crimped over the outer periphery of the other layer. Depending on the complexity of the article, the hemming or crimping operation can be time consuming and labor intensive. For example, the shape of an upper heat shield located between the floor and catalytic converter of motor vehicles is quite complex. These types of heat shields typically have outer peripheries with complex curvatures that may extend along three mutually perpendicular axes and/or combinations thereof. During the hemming operation, the heat shield must be positioned and repositioned as many as six times or more indifferent presses in order to properly crimp one layer over the other while following the complex curvatures. Each press typically has a set of dies that conforms to a portion of the outer peripheral shape of the upper and lower sheet metal layers for a particular orientation of the heat shield. When the shape of the heat shield is modified, new sets of dies must be manufactured. The dies are costly to manufacture and difficult to maintain, and thus contribute to the overall cost of the heat shields.

SUMMARY OF THE INVENTION

These and other problems of the prior art are overcome by an apparatus and method for joining together two superimposed sheets of material through a single hemming operation.

According to one embodiment of the invention, a system for joining together a pair of superimposed layers of ductile material at their peripheral edges through a single hemming operation includes a base member for supporting one of the layers, a clamp member positioned above, and displaceable toward the other layer for contacting the other layer and temporarily holding the layers together between the base member and clamp member, a retainer having an upper surface with at least one groove formed therein, at least one resiliently deformable hemming member located in the at least one groove, and an anvil positioned above, and displaceable into contact with the hemming member. The groove in the retainer extends adjacent the peripheral flange of the one layer when the one layer is supported on the base. The anvil is shaped to deform the hemming member toward the peripheral flange of the one layer as the anvil presses against the hemming member. Preferably, a ram is coupled to the anvil for pressing the anvil against the hemming member to deform the same. With this arrangement, deformation of the hemming member causes deflection of the peripheral flange around the peripheral edge of the other layer.

In a preferred arrangement, the ram is also coupled to the clamp member for simultaneous movement of the clamp member and anvil toward the superimposed layers and the hemming member, respectively. The clamp member contacts the other layer to thereby clamp the layers together before deforming the hemming member and subsequently deflecting the peripheral flange. A constant force cylinder is preferably mounted between the ram and the clamp member to hold the layers between the base member and the clamp member under constant force as the ram continues movement toward the layers and the hemming member.

According to a further embodiment of the invention, at least one of the retainer and the anvil is constructed of a plurality of blocks. Each block is shaped to a particular configuration and occupies a unique position with respect to the other blocks to thereby complement the outer peripheral shape of at least one of the superimposed layers. When the anvil is constructed of the plurality of blocks, a lower face of each block extends at an acute angle with respect to horizontal toward the clamp member to thereby deform the hemming member toward the peripheral flange when the anvil is pressed against the hemming member.

A method according to the invention for joining together a pair of layers of ductile material at their peripheral edges includes forming a peripheral flange on one of the layers, superimposing and clamping the layers on a base, positioning a resiliently deformable hemming member at least in close proximity to the peripheral flange, and bending the peripheral flange around the peripheral edge of the other layer by deforming the hemming member toward the peripheral flange. Preferably, the hemming bead is constructed of a resilient material that may have a varying cross-sectional shape with a volume that remains substantially constant when compressed, such as a durable elastomeric material that is either solid or fluid-filled.

Since the hemming member is continuous along the outer periphery of the article, the entire hem can be formed in a single operation, as opposed to the six or more operations of the prior art, and results in a more evenly distributed metal flow of the hemmed edge, especially around complex shapes. The flexible hemming member substantially eliminates or at least greatly reduces the amount of edge distortion as compared to the prior art.

These and other objects, features and advantages will be apparent from the ensuing description taken in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
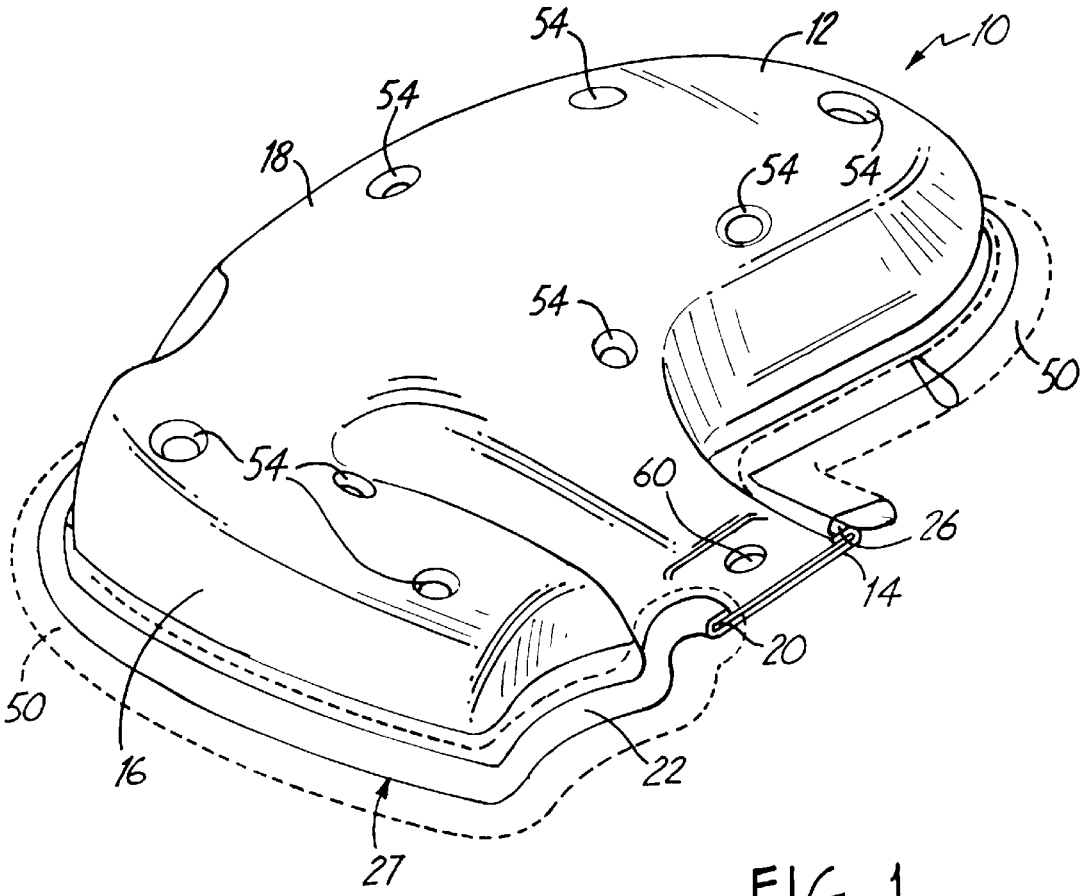
FIG. 1 is a perspective view of a heat shield formed according to the present invention and showing in phantom line a flexible peripheral bead used in crimping a lower layer to an upper layer of the heat shield.

Referring now to FIG. 1, a heat shield 10 includes an upper sheet metal layer 12 and a lower sheet metal layer 14.

Figure 5:
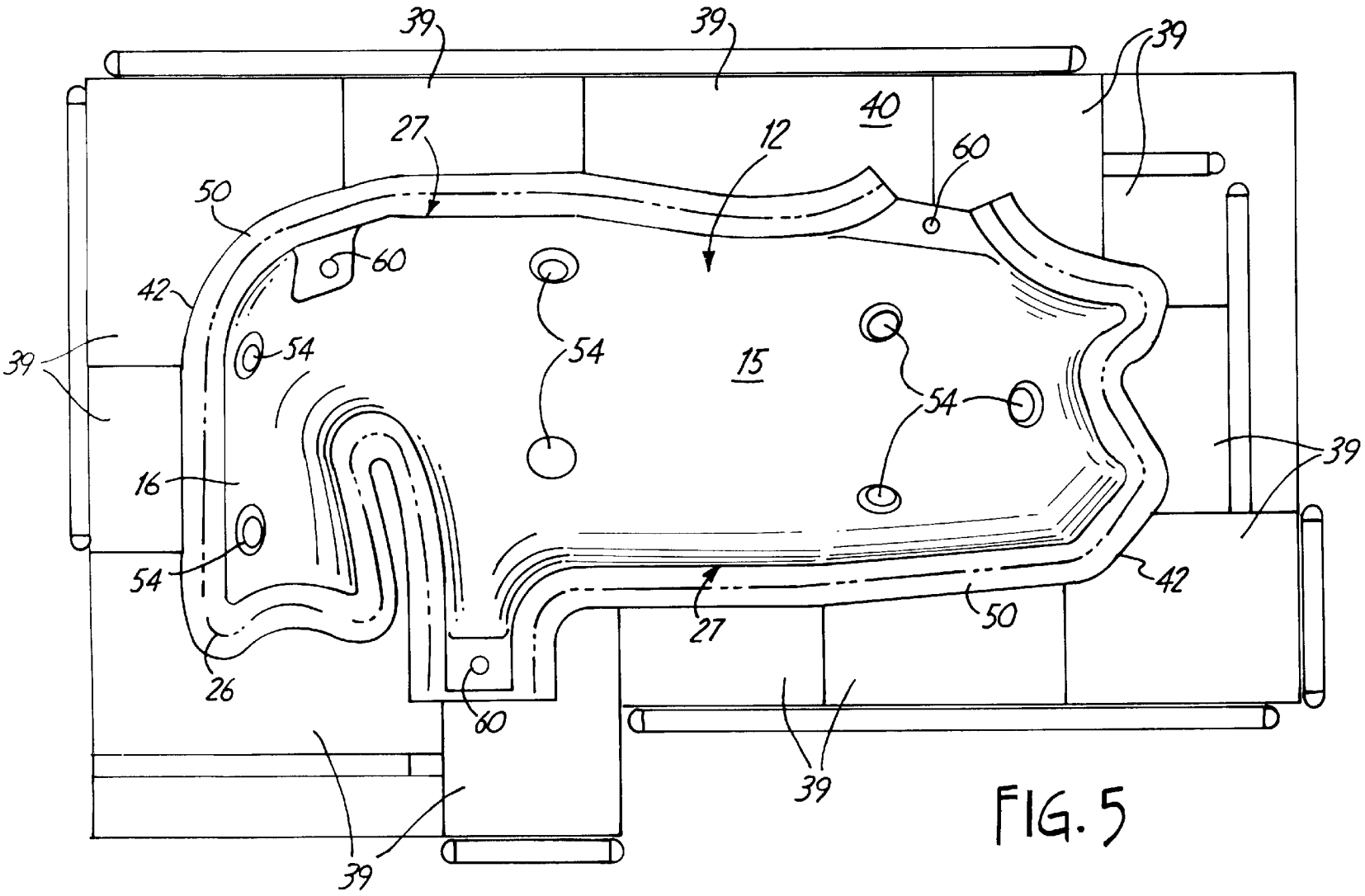
FIG. 5 is a top plan view of a heat shield and block assembly according to the invention.

The upper layer 12 is stamped to a particular shape from a single piece of material and includes an upper surface 15 and a lower surface 17. A side 16 extends around the periphery of the upper layer 12 and is continuous with a top 18. A lower edge 20 of the side 16 faces the lower layer 14 when assembled thereto. Several depressions 54 (FIG. 2) are formed in the upper layer 12 and directly contact the lower layer 14 to resist deformation of the upper sheet during the hemming operation and to assure the integrity of an insulating air space 56 formed between the upper and lower sheets. The lower sheet metal layer 14 is also stamped to a particular shape from a single piece of material and includes an upper surface 22 and a lower surface 24. An upwardly projecting flange 26 extends around the lower periphery of the layer 14 and initially projects approximately perpendicular to a portion of the upper surface 22 immediately adjacent the flange 26 before the hemming operation. As shown in FIGS. 1 and 5, the heat shield has an outer peripheral shape 27 that includes several complex curves.

Figure 2:
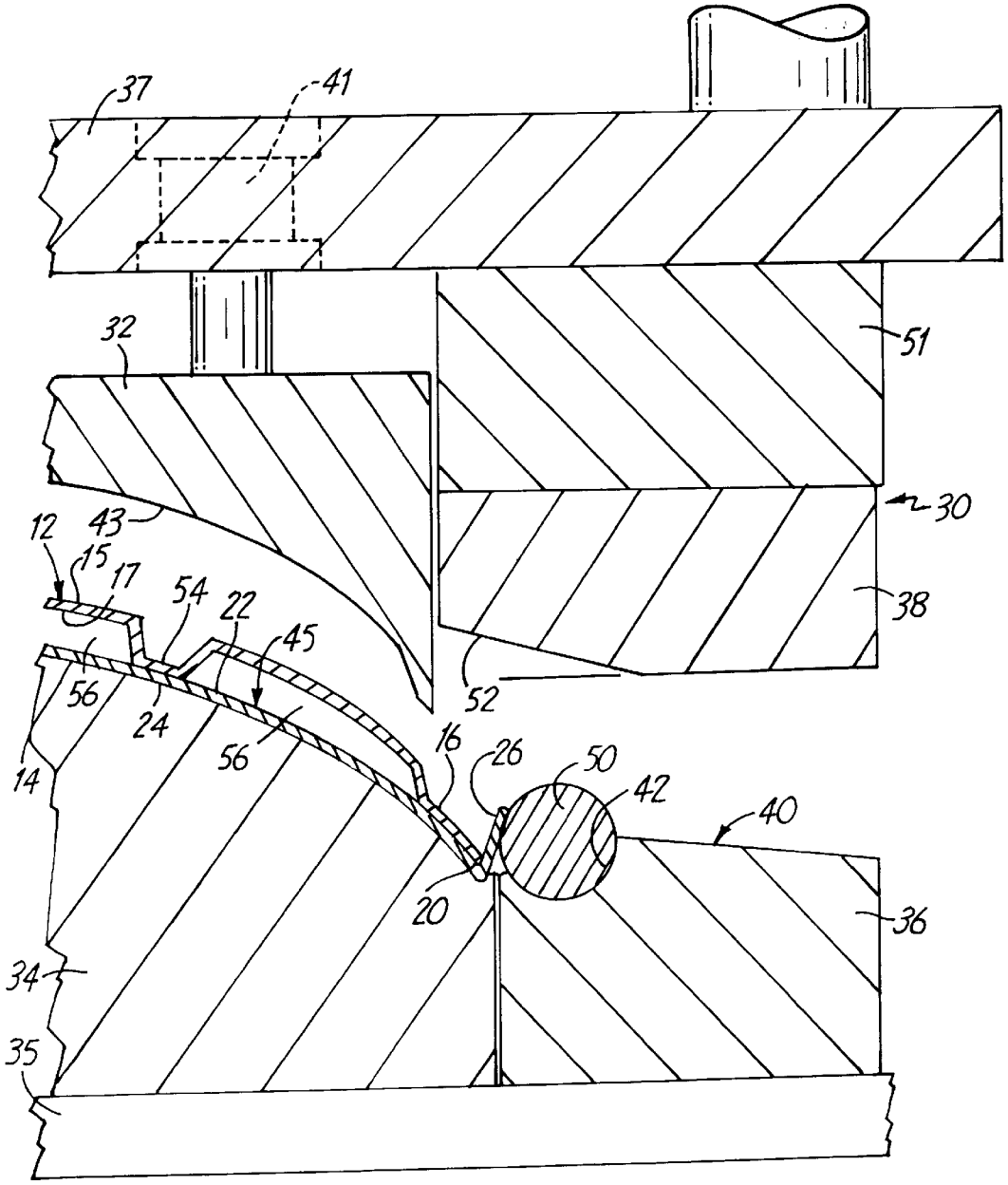
FIG. 2 is a cross-sectional view of a portion of the heat shield and die assembly before the hemming operation.
Figure 3:
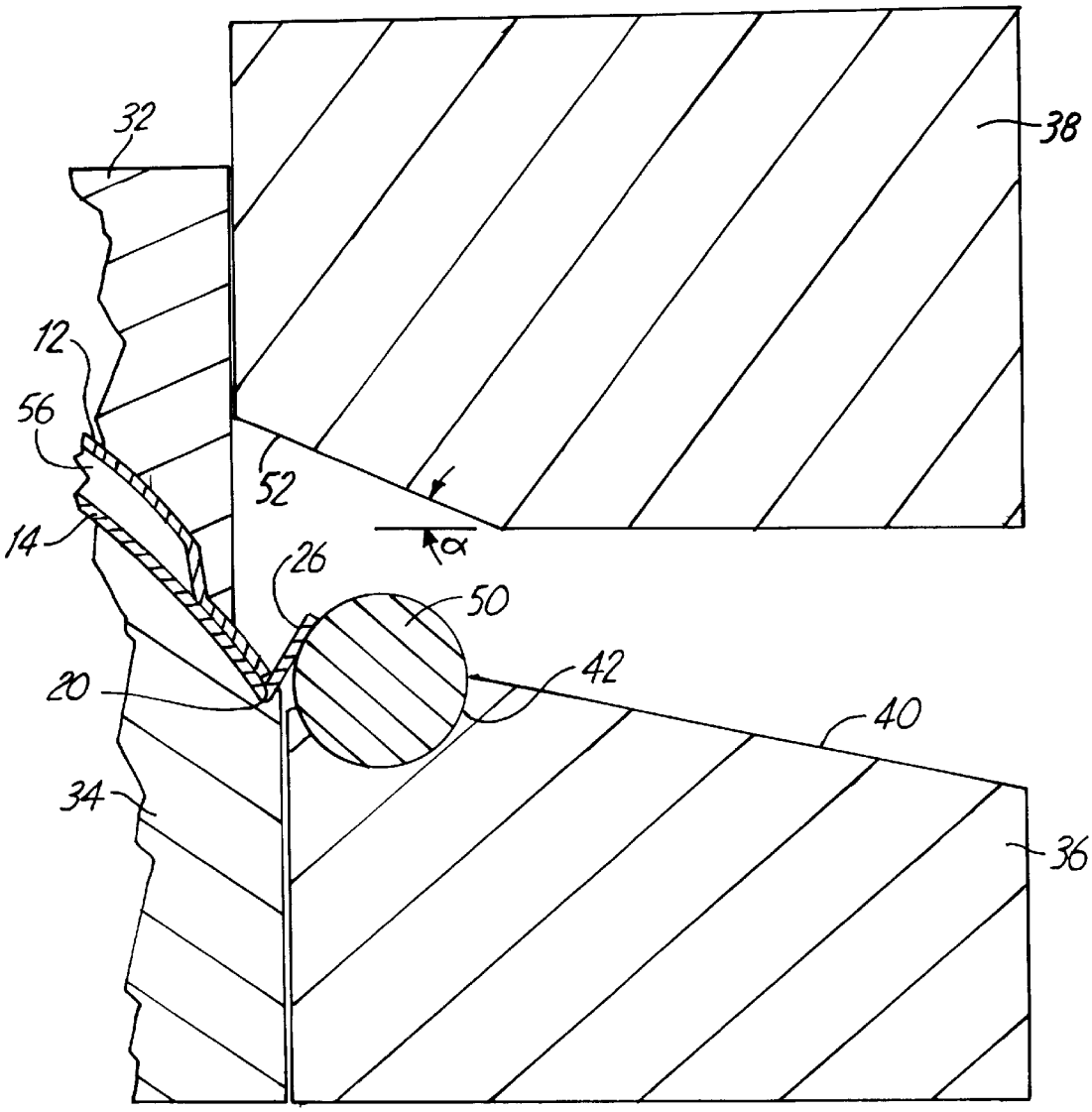
FIG. 3 is a cross-sectional view of a portion of the heat shield and die assembly during the hemming operation.
Figure 4:
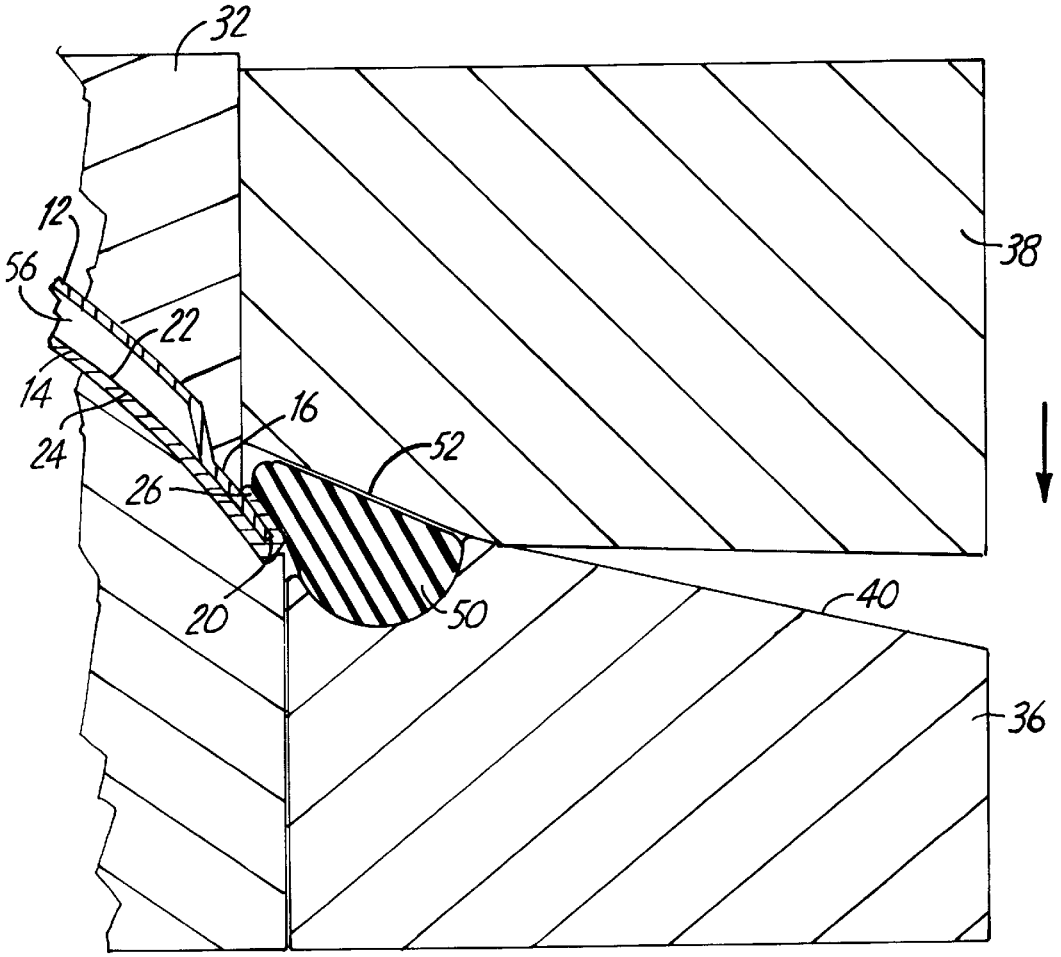
FIG. 4 is a cross-sectional view of a portion of the heat shield and die assembly at the completion of the hemming operation.

With reference now to FIGS. 2–5, an assembly 30 for hemming the two layers 12 and 14 together comprises a lower punch or base 34 that is attached to a stationary bolster 35 and an upper clamping pad 32. The pad 32 is biased downward toward the punch 34 from an upper ram 37 via one or more nitrogen die force cylinders 41 (shown in dashed lines) or other device that generates a substantially constant force through a predetermined stroke range. The ram 37 is moveable from an upper position (FIG. 2), through a lower clamping position (FIG. 3), and to a lower crimping position (FIG. 4). Preferably, a lower surface 43 of the upper clamping pad 32 complements the shape of the upper surface 15 of the layer 12. Likewise, an upper surface 45 of the lower punch 34 preferably complements the shape of the lower surface 24 of the layer 14.

The assembly 30 further comprises a lower stationary retainer 36 formed from several blocks 39 (FIG. 5) that are securely attached to the bolster 35 and extend around the periphery of the lower sheet 14. Each block is machined to a particular configuration and occupies a unique position to complement the outer peripheral shape 27 of the heat shield. The lower stationary retainer includes an upper surface 40 having semi-cylindrical grooves 42 formed therein. The grooves 42 extend around the periphery of the lower sheet 14 adjacent to the flange 26. Instead of forming the retainer with several blocks, a single block can be machined to form the retainer. Before the hemming operation, a cylindrical hemming bead 50 is positioned in each groove 42 adjacent to the flange 26. Although two grooves 42 and beads 50 are shown in FIG. 5, it is to be understood that more or less grooves and beads can be used depending on the particular heat shield configuration. Moreover, the hemming bead is not limited to the cylindrical shape as described above, but can be formed of different shapes depending on the particular article to be hemmed. The hemming bead 50 is constructed of a flexible material having a volume that remains substantially constant when compressed. Preferably, the hemming bead 50 is constructed of a durable elastomeric material having a Shore A rating in the range of 50 to 90 durometer and that is either solid or fluid-filled. The purpose of the hemming bead 50 will be described in greater detail below.

An upper displacement anvil 38 also forms part of the hemming assembly 30 and is securely attached to the ram 37 via a spacer block 51. The anvil 38 extends around the periphery of the upper sheet 12 and is superimposed over the grooves 42 and beads 50. The anvil 38 can be constructed with several machined blocks (not shown) in a similar manner as the retainer 36. The upper displacement anvil 38 includes a lower surface 52 that extends at an acute angle a with respect to horizontal. Preferably, the angle is in the range of about 10° to about 50°. The surface 52 can additionally or alternatively be concave or convex.

In operation, the ram 37 with the accompanying pad 32 and anvil 38 are in a raised position, as illustrated in FIG. 2. The lower preformed sheet 14 is placed on the punch 34 such that the outer peripheral flange 26, which initially extends at approximately 90° with respect to the upper surface 22 immediately adjacent the flag, abuts the hemming bead 50. The upper preformed sheet 12 is then placed over and aligned with the lower sheet 14. The initial distance between the pad 32 and upper sheet 12 is greater than the initial distance between the lower surface 52 of the anvil 38 and the hemming member 50. The pad 32 will therefore contact and hold the upper layer 12 against movement before the anvil 38 contacts the hemming member 50 when the ram 37 is lowered, as illustrated in FIG. 3. In the clamped position, the lower surface 24 of layer 14 contacts the upper punch surface 45 while the upper surface 15 of the layer 12 contacts the damping pad lower surface 43 to securely hold the layers together. The depressions 54 assure that the upper layer is not deformed under pressure from the pad 32. As the ram 37 continues to descend, a constant pressure is exerted on the upper layer 12 by the pad 32 due to the constant force cylinders 41. The lower angled surface 52 of the anvil 38 also contacts the elastomeric hemming member 50 and deforms the member toward the flange 26, as illustrated in FIG. 4. The angle of the lower surface 52 and the position of the hemming member 50 in the retainer 36 ensures that the hemming member is trapped securely between the anvil and the retainer and deflects only toward the flange to bend the flange over the edge 20. The shape of the anvil and retainer also ensures that a portion of the hemming member is not pinched off at the bottom of the stroke. When the hemming operation is completed, the flange 26 extends in a direction approximately 90° from its original position, or 180° with respect to a portion of the upper surface 22 immediately adjacent to the flange 26, as shown in FIGS. 1 and 4. The hemming member 50 also returns to its original shape. Since the hemming member 50 is continuous along the outer periphery 27, the entire hem can be formed in a single operation, as opposed to the six or more operations of the prior art, and results in a more evenly distributed metal flow of the hemmed edge, especially around complex shapes, which substantially eliminates or at least greatly reduces the amount of edge distortion such as splitting, caused by localized excessive metal reduction. A set of mounting holes 60 for installing the heat shield to a vehicle or other structure can be simultaneously pierced in the heat shield during the hemming operation. A punch (not shown) is lowered simultaneously with the anvil 38 to form the mounting holes 60 as the flange 26 is hemmed.

Although the present invention has been described in context with a heat shield for the catalytic converter of a vehicle, it is to be understood that the hemming operation can be used for other articles having two sheet metal components that are joined together through crimping.

Reasonable variation and modification are possible within the spirit of the foregoing specification and drawings without departing from the scope of the invention.

The embodiments for which an exclusive property or privilege is claimed are defined as follows:

1. A method for joining together a pair of superimposed layers of ductile material at their peripheral edges, the peripheral edge of one of the layers having a peripheral flange which extends beyond the peripheral edge of the other of the layers, the method comprising:

clamping the superimposed layers on a base;

positioning a resiliently deformable hemming member at least in close proximity to the peripheral flange; and bending the peripheral flange around the peripheral edge of the other layer by deforming at least a portion of the hemming member toward the peripheral flange, with the deformed portion of the hemming member directly engaging the peripheral flange.

2. A method according to claim 1 wherein the step of deforming the hemming member includes simultaneously deforming the hemming member along its entire length.

3. A method according to claim 2 wherein the step of positioning the hemming member includes providing a retainer with a groove in close proximity to the outer edge of the peripheral flange and placing the hemming member in the groove.

4. A method according to claim 1 wherein the hemming member is formed of a material that exhibits a substantially constant volume during its deformation.

5. A method according to claim 4 wherein the hemming member is formed of an elastomeric material.

6. A method according to claim 1 wherein a peripheral portion of the one layer is bent upwardly to form the peripheral flange before the step of clamping the superimposed layers on a base.

7. A method according to claim 1 wherein a plurality of depressions are formed in the other layer to directly contact the one layer before the step of clamping the superimposed layers on a base to thereby maintain a space between the layers during the step of bending the peripheral flange.

8. A method according to claim 1 and further comprising the step of forming at least one mounting hole in the superimposed layers during the step of deforming the hemming member.

9. A method for hemming sheet metal comprising:

placing a first layer of sheet metal proximate to a second layer of sheet metal so that at least a portion of an edge of the first layer and at least a portion of an edge of the second layer are aligned so that a hem may be formed;

aligning the edges of the first and second layer corresponding to the hem to be formed with a hemming bead; and applying force to the hemming bead which causes at least a portion of the hemming bead to deform from its original shape, so that the deformation of the hemming bead from its original shape to a deformed shape causes the deformed portion of the hemming bead to engage at least one of the layers of sheet metal, thus forming the hem between the first layer of sheet metal and the second layer of sheet metal.

10. The method of claim 9 further, comprising:

removing the application of force to the hemming bead after the hem is formed; and allowing the hemming bead to return to its original shape.

11. The method of claim 9 wherein the hemming bead is formed from elastomeric material.

12. The method of claim 9 wherein the hemming of the first layer sheet metal to the second layer of sheet metal forms a complete part and the complete part is formed with a single press stroke.

13. The method of claim 12 wherein substantially the entire edge of the first layer of sheet metal and substantially the entire edge of the second layer of sheet metal form the hem.

14. The method of claim 13 wherein the hem is non-linear.

15. The method of claim 12 wherein the hem is non-linear.

16. The method of claim 12 wherein a single hemming bead is used.

17. The method of claim 12 wherein a plurality of hemming beads are used.

18. The method of claim 9 wherein a volume of the hemming bead remains constant during the deformation of the hemming bead.

* * * * *